United States Patent [19]

Kim et al.

[11] 4,320,210

[45] Mar. 16, 1982

[54] ETHYLENE POLYMER FIBRILS

[75] Inventors: Jin K. Kim; Clarence R. Murphy, both of Houston, Tex.; Edward W. Smith, Gibsonia, Pa.

[73] Assignee: Gulf Oil Corporation, Pittsburgh, Pa.

[21] Appl. No.: 215,905

[22] Filed: Dec. 12, 1980

[51] Int. Cl.[3] ..... C08L 23/26; C08L 29/04; C08L 23/06

[52] U.S. Cl. ..... 525/57; 264/13; 264/232; 264/340; 264/343

[58] Field of Search ..... 525/57; 264/13, 232, 264/340

[56] References Cited

U.S. PATENT DOCUMENTS

| | | | |
|---|---|---|---|
| 3,848,027 | 11/1974 | Forbess et al. | 525/57 |
| 4,134,931 | 1/1979 | Hayes et al. | 525/57 |
| 4,152,317 | 5/1979 | Agouri et al. | 260/42.46 |

*Primary Examiner*—Carman J. Seccuro

*Attorney, Agent, or Firm*—Richard L. Kelly

[57] ABSTRACT

Improved ethylene polymer fibrils are provided which are characterized in having:

(a) a melt temperature of at least about 137° C.,
(b) a molecular weight of at least 250,000,
(c) at least about 1.2 weight % of polyvinyl alcohol sorbed thereon, and
(d) a zero-span breaking length of at least about 25,000.

Water-laid sheets prepared from the fibrils have the following minimum factored values:

Mullen Burst: 30 psi
Elmendorf Tear Strength: 300 grams/sheet
Tensile Strength: 15 lbs/inch
Elongation at Break: 40%

3 Claims, 1 Drawing Figure

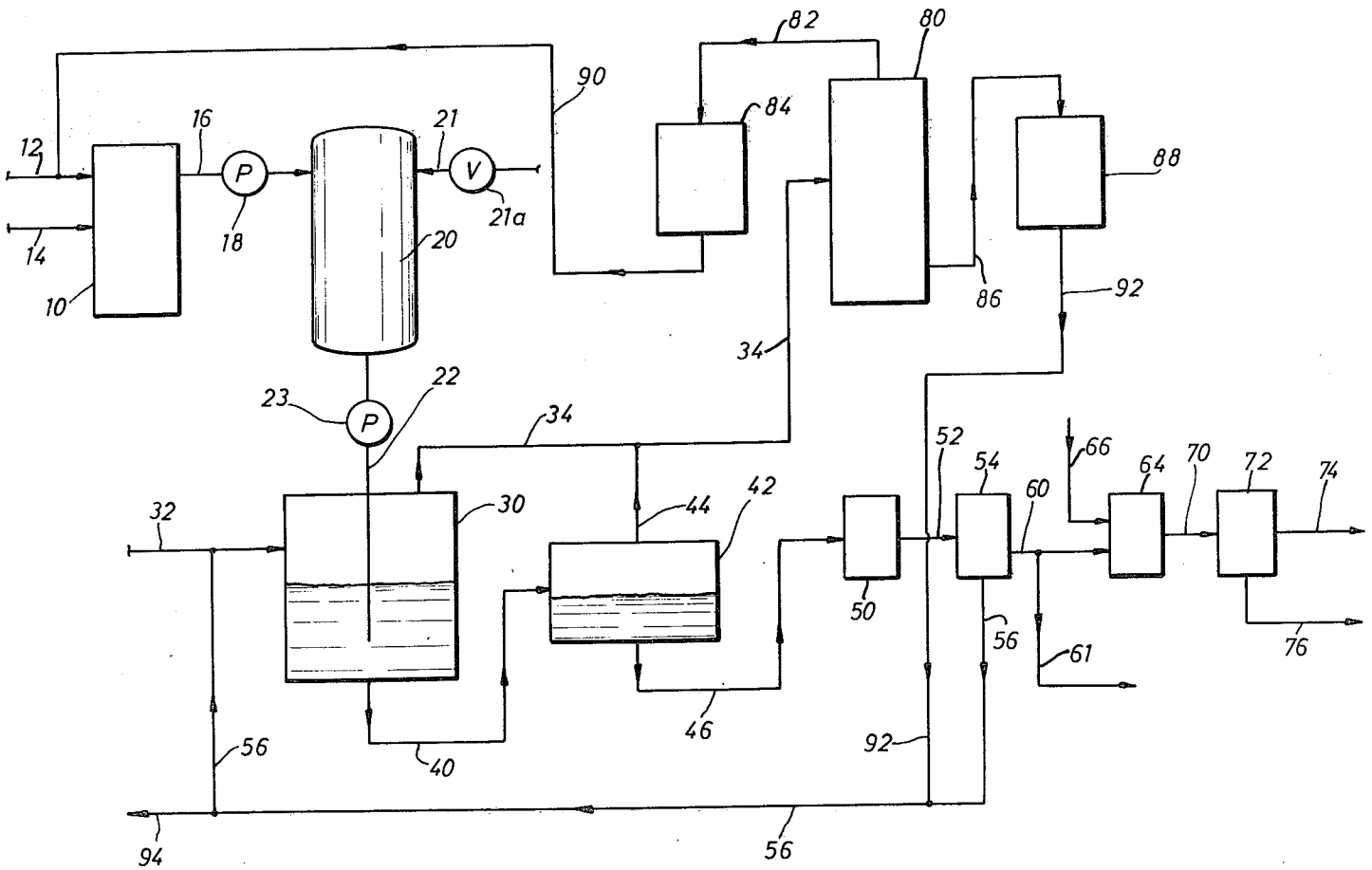
10
12
14
16
18
P
20
21
21a
V
22
23
P
30
32
34
40
42
44
46
50
52
54
56
60
61
64
66
70
72
74
76
80
82
84
86
88
90
92
94

ETHYLENE POLYMER FIBRILS

BACKGROUND OF THE INVENTION

The term "fibrils"* has been employed to define fiber-like materials that are prepared by dissolving a thermoplastic polymer such as an ethylene polymer in a solvent, subjecting the polymer solution to a shearing action, and simultaneously or immediately thereafter precipitating the polymer from the polymer solution by rapid cooling or by adding a nonsolvent to the polymer solution. The belief has been expressed in many literature and patent publications that the shearing action attenuates the solute polymer molecules to provide orientation therein. The orientation is retained as the polymer is rapidly precipitated from solution. The term fibrils suggests that the physical structure of the products is fiber-like, i.e., rod-like and having one principal dimension. In actual fact, when the fibrils are examined on a microscopic scale, they are observed to have a very complex structure that can not be meaningfully described in words.

*The term "fibrids" is sometimes used and has the identical meaning as "fibrils."

The principal applications of fibrils described in the literature are as full or partial replacements for cellulose fibers in the manufacture of water-laid sheets, i.e., synthetic paper. Prior to the rapid increases in petroleum prices beginning in the early 1970's, it was believed that the price of ethylene polymers ultimately would fall below the price of cellulosic fibers. On this basis, it was believed that ethylene polymer fibrils could partially displace cellulose fibers in the manufacture of paper on the basis of price alone. This view is no longer valid. It is now clear that ethylene polymer fibrils will remain more expensive than cellulose fibers and will be used in the manufacture of water-laid sheets only when their performance properties are sufficiently good to warrant a premium price vis-a-vis cellulose fibers. The majority of the ethylene polymer fibrils described in the art are actually somewhat inferior to cellulose fibers for use in the manufacture of water-laid sheets.

For the above reasons, there is a need in the art for ethylene polymer fibrils having significantly improved properties when used to manufacture water-laid sheets.

SUMMARY OF THE INVENTION

The applicants have developed superior ethylene polymer fibrils which, when converted into water-laid handsheets, provide sheets having the following minimum factored values:

Mullen Burst—30 psi
Elmendorf Tear Strength—300 grams/sheet
Tensile Strength—15 lbs/inch
Elongation at Break—40%

The fibrils are further characterized in having:

(a) a melt temperature of at least about 137° C.,
(b) a molecular weight of at least 250,000,
(c) at least about 1.2 weight % of polyvinyl alcohol sorbed thereon, and
(d) a zero-span breaking length of at least about 25,000.

Throughout the balance of this application, for brevity, the products of the invention will be referred to simply as fibrils; it being understood that they are fabricated from an ethylene polymer.

BRIEF DESCRIPTION OF THE DRAWING

The single drawing is a schematic flow sheet showing a process that can be employed to prepare the fibrils of the invention.

DETAILED DESCRIPTION OF THE INVENTION

The fibrils of the invention are characterized both by certain properties measured directly on the fibrils themselves and by additional properties measured on water-laid hand sheets prepared from such fibrils. The terms employed to define the fibrils herein and in the appended claims and the test methods employed to measure such properties are set forth infra in the section entitled "Definition of Terms and Test Methods."

The molecular weight of the fibrils is at least 250,000, preferably at least 300,000, and more especially at least 350,000. The molecular weight of the fibrils is the molecular weight obtained directly on the fibrils themselves and not the ethylene polymer from which the fibrils were prepared. It is important that this distinction be recognized as the molecular weight is reduced significantly by the process employed to manufacture the fibrils. As discussed infra, the molecular weight of the fibrils is less than 35% of the molecular weight of the ethylene polymer from which the fibrils are prepared.

The melt temperature of the fibrils is at least 137° C. and preferably at least 138° C. The melt temperature is controlled by the ethylene polymer's crystallinity and molecular weight. As the density and/or the molecular weight is increased, there is a corresponding increase in the melt temperature.

The fibrils will have at least about 1.2 weight % and preferably at least about 4.0 weight % of polyvinyl alcohol sorbed on the fibrils. The manner in which the polyvinyl alcohol is sorbed on the fibrils is discussed infra.

The fibrils will have a zero-span breaking load of at least 25,000 and preferably at least 30,000. The zero-span breaking point is believed to be an indirect measurement of the complex physical structure of the fibrils. Empirically it has been observed that the measured zero-span breaking load correlates well with the strength properties of water-laid hand sheets prepared from the fibrils.

The physical properties of the fibrils are dependent upon the physical properties of the ethylene polymer from which they are prepared and the process by which they are prepared.

The ethylene polymer employed to prepare the fibrils must have a density of at least 0.93, preferably at least 0.94, and more especially at least 0.95 grams/ml. It must have a melt temperature of at least 140° C. and an apparent melt viscosity of at least $1.3\times10^6$ poises at 300° C., measured at an apparent shear rate of 1 second$^{-1}$, which corresponds to a molecular weight of 1 million. Ethylene polymers having these properties are commercially available and can be prepared by polymerization methods employing Ziegler-type catalysts.

The fibrils of the invention are prepared by processes operated at high temperatures, e.g., 125° C. or higher, and which impose intense shearing forces on the ethylene polymer before the fibrils are precipitated from the ethylene polymer solution. While the process steps of the process can be varied, the combination of the high operating temperature and the shearing forces must be controlled to be sufficiently severe so that the molecular weight of the starting ethylene polymer is reduced by at least 65%. Stated in the alternative, the molecular weight of the fibrils must be less than 35% of the molecular weight of the ethylene polymer from which they are prepared.

After the fibrils have been prepared, they are treated with a liquid which is miscible with both water and the solvent employed to prepare the fibrils. The liquid employed preferably is an oxygen containing liquid such as an alcohol, e.g., methanol or ethanol, a polyhydride compound such as ethylene glycol, propylene glycol, or glycerine, or a ketone such as acetone. A propanol such as n-propanol and especially isopropanol is the preferred compound for such use. The treatment can be carried out in conventional refining equipment such as Waring Blendors, disc mills, and the like. The refining removes residual solvent from the fibrils and also appears to have a desirable effect on the morphology of the fibrils.

The fibrils, after being refined as described above, are treated with an aqueous solution of polyvinyl alcohol (PVA) under high shearing forces to sorb at least about 1.2 weight %, and preferably at least about 4.0 weight % of polyvinyl alcohol on the fibrils. The precise manner in which the PVA becomes associated with the fibrils has not been established. In this application, the term "sorb" will be used to denote this association, whatever it may be.

The PVA is sorbed on the fibrils by suspending the refined fibrils in an aqueous solution of PVA and subjecting the suspension to high shearing forces. On a laboratory scale, the treatment is conveniently effected in a Waring Blendor. On a larger scale, the treatment can be effected in a disc mill or like refiner with the clearance being set to provide high shear on the suspension. Another means for effecting the treatment is to stir the suspension of fibril in the PVA solution, while subjecting the suspension to ultrasonic vibrations. This method of treatment is described in U.S. Pat. No. 4,134,931.

The polyvinyl alcohol solution employed will have dissolved therein about 2–15 and preferably about 4–10 weight % of the polymer. The weight ratio of fibrils to polyvinyl alcohol solution employed will be such that a minimum of 1 and preferably at least 10 parts of polyvinyl alcohol are present per 100 parts of the fibrils. The treatment can be carried out in a single step, or in multiple steps in which the fibrils are treated with fresh aliquots of the PVA solution. In all cases, the treatment will be such to sorb the minimum percent of PVA as previously set forth. The grade of polyvinyl alcohol employed in the process is not critical. Vinol 540 sold by Air Products and Chemicals provides satisfactory results.

The preferred process for the manufacture of the fibrils of the invention is described in our patent U.S. Pat. No. 4,181,794. The process consists of heating a solution of the ethylene polymer in a defined class of solvents in a first zone operated at superatmospheric pressure, and transferring hot polymer solution from the pressurized first zone through an elongated tubular transfer member to a second zone operated at substantially atmospheric pressure where the hot polymer solution is discharged into a stirred bath of a propanol to form fibrils therefrom. The polymer solvent is recovered by distillation and recycled to the process. The fibrils produced are refined in the propanol slurry in which they are prepared. The propanol then is recovered and recycled to the process.

The polymer solvent employed will be any solvent which is characterized by four parameters. First, it will have the capacity of dissolving at least about 1.0 and preferably 2.0 or more weight % of the ethylene polymer under the temperature and pressure conditions prevailing in the pressurized first zone of the process. Second, it will have a limited capacity of dissolving not more than about 0.2 weight % of the ethylene polymer at ambient temperature when diluted with an equal volume of propanol. Third, it will have an atmospheric boiling point of less than about 65° C. Fourth, it will not form an azeotrope with n-propanol or isopropanol. Suitable examples of such solvents include chloroalkanes such as ethyl chloride, methylene chloride, chloroform, carbon tetrachloride, certain of the chlorofluoroalkanes, e.g., trichlorofluoro methane, and certain selected hydrocarbons such as cyclopentane.

In the first zone of the process, the ethylene polymer and the ethylene polymer solvent are introduced into a pressure resistant tank. The polymer and the solvent can be fed to the tank in separate streams, or as a previously formed solution, or as a slurry of polymer solids dispersed in the solvent. The polymer and solvent are introduced in a fixed ratio such that all of the polymer will dissolve at the temperature employed in the first zone. Typically, 2–12 and preferably 4–10 parts by weight of polymer are employed per 100 parts by weight of solvent. The temperature is maintained at about 150° C. or higher, preferably at 180° C. or higher. At such temperatures the solvent will dissolve a significant quantity of ethylene polymer and, at the same time, the polymer solution will have a relatively low viscosity so that it can be readily processed. The temperature employed will generate a relatively high pressure of the order of at least about 25 and preferably at least about 40 atmospheres in the first zone. If desired, the pressure may be maintained at a fixed level by introducing an inert gas, such as nitrogen, as required.

The polymer solution formed in the first zone is transferred to a second zone by means of a suitable elongated tube-like transfer member having one or a plurality of restricted discharge orifices. Typically, the orifice(s) will have a diameter of the order of 1–10 mm. The orifice(s) are sized such that the polymer solution flows through the orifice(s) at a relatively high rate so as to subject the polymer solution to high shear. A valve or preferably a pump is included in the transfer line so that the polymer solution is transferred from the first zone to the second zone at a preselected steady rate.

The second zone of the process is a stirred vessel operated at substantially atmospheric pressure. The vessel is provided with an inlet through which a propanol, either n-propanol or isopropanol, is continuously fed to maintain a liquid level above the discharge orifice(s) of the tube-like transfer member which delivers the hot polymer solution to the vessel. As hot polymer solution is discharged into the propanol from the discharge orifice(s) of the transfer member, the polymer solution expands rapidly by reason of the pressure differential existing between the first zone and the second zone. The molten polymer undergoes significant shear by reason of this expansion. The shear thus imposed, both in passing through the discharge orifice and in expansion upon discharge therefrom, orients the solute polymer molecules in the polymer solution. The rapid cooling of the polymer solution, coupled with the diffusion of the propanol into the polymer solution, precipitates the polymer in the form of fibrils which have the orientation frozen therein.

The heat introduced into the second zone by the hot polymer solution increases its temperatures to a level at which a substantial portion of the polymer solvent is vaporized. This vaporized polymer solvent is removed from the vessel for recovery as subsequently described. If desired, additional heat can be introduced into the second zone by conventional heat transfer means to vaporize additional quantities of the polymer solvent.

The propanol is stirred vigorously to disperse the precipitated polymer fibrils throughout the propanol to form an easily-handled slurry. The slurry is continuously withdrawn from the second zone and fed to a flash distillation apparatus to flash-distill the remaining polymer solvent from the propanol.

The slurry of the fibrils in the propanol, which now is substantially free of any polymer solvent, then is fed to a refining step. In the refining step, the slurry is passed through any suitable type of refiner to improve their physical properties. Preferably, this refining step is carried out in a disc refiner, or in a series of disc refiners aligned in series.

The slurry of refined fibrils in propanol next is separated from the propanol associated therewith. Preferably this operation is carried out in a centrifuge with the recovered propanol being recycled to the second zone of the process. The separated fibrils can be recovered at this stage of the process. Preferably, however, the fibrils are given an additional refining in an aqueous solution of polyvinyl alcohol (PVA) to improve their properties. After the fibrils have been refined in the presence of PVA, they are recovered for shipment or use.

The polymer solvent recovered from the second zone, which may have some propanol associated therewith, is fed to a distillation column. The polymer solvent, having a lower boiling point than the propanol and not forming an azeotrope therewith is recovered as an overhead fraction which can be recycled to the first zone of the process. Some small quantity of polymer solvent may build up in the propanol recovered from fibrils and recycled to the second zone of the process. To recover such polymer solvent for recycling to the first zone of the process, a slipstream of such propanol-polymer solvent can be fed to the distillation column.

The propanol employed in the process serves a dual function in the process. For one, it is an efficient nonsolvent for precipitating the olefin polymer from the polymer solution in the second zone of the process. Second, the propanol, for reasons not fully understood, materially aids in the refining of the fibrils so that they develop excellent physical properties.

The apparatus illustrated in the drawing includes a polymer slurry tank 10 equipped with a suitable stirrer and heating means not shown. Line 12 is provided to feed polymer solvent to tank 10. Line 14 is provided to feed polymer solids to tank 10. Line 16, having a pump 18 therein, is provided to transfer polymer slurry from tank 10 to a pressure resistant tank 20.

Tank 20 is designed to operate safely at pressures of the order of 50 atmospheres or higher. A line 21 having a regulating valve 21*a* therein is provided to feed an inert gas to tank 20 intermittently as required to maintain a preselected pressure. An elongated tube-like member 22, having a pump 23 therein, is provided to transfer polymer solution from tank 20 to vessel 30. The discharge end of 22 is provided with suitable discharge orifices not shown.

Vessel 30 is provided with stirring and heating means not shown. Line 32 is provided to feed isopropanol to vessel 30. Line 34 is provided to remove distillate from vessel 30. Line 40 is provided to feed a slurry of fibrils and isopropanol to a flash distillation apparatus 42, which includes suitable heating means not shown. Line 44 is provided to remove overhead distillate from 42. Line 46 is provided to transfer the slurry of fibrils in isopropanol from 42 to fibril refining apparatus 50, which typically is a disc refiner.

Line 52 is provided to transfer the slurry of refined fibrils in isopropanol from the outlet side of refining apparatus 50 to separation apparatus 54, which typically is a centrifuge. Line 56 is provided to recycle isopropanol to line 32. Line 60 is provided to recover the fibrils from separating apparatus 54. Line 60 feeds directly to a second refining apparatus 64, which again typically is a disc refiner. Line 66 is provided to feed aqueous polyvinyl alcohol solution to refining apparatus 64. Line 61 is provided for optional direct recovery of fibrils from line 60.

Line 70 transfers refined slurry from 64 to separation apparatus 72, which again typically is a centrifuge. Line 74 is provided to recover fibrils from 72. Line 76 is provided to remove the aqueous polyvinyl alcohol solution from 72.

Line 34 is provided to feed distillate from vessel 30 and distillation apparatus 42 to approximately the midpoint of a distillation column 80. Line 82 feeds overhead from column 80 to an intermediate storage tank 84. Line 86 feeds a bottoms fraction from column 80 to a second intermediate storage tank 88. Line 90 feeds liquid from intermediate storage tank 84 to line 12. Line 92 feeds liquid from intermediate storage tank 88 to line 56. Line 94 is teed to line 56 to remove a slipstream therefrom.

In operation of the process, a finely-divided ethylene polymer having a molecular weight of at least about one million is fed via line 14 to a polymer slurry tank 10. A suitable solvent such as methylene chloride is fed via line 12 to polymer slurry tank 10. Typically, 6 parts of ethylene polymer are employed for each 100 parts of methylene chloride. The mixture is stirred well to suspend the fine polymer particles throughout the methylene chloride. Optionally, tank 10 may be heated to dissolve a substantial portion of the olefin polymer.

The methylene chloride slurry of the ethylene polymer is transferred to pressure tank 20 via line 16 by means of a suitable pump 18. Tank 20 is heated to a temperature of about 180° C. to develop a pressure of the order to 30 atmospheres. The olefin polymer dissolves in the methylene chloride under the prevailing temperature. An inert gas such as nitrogen from a high pressure source not shown may be fed to tank 20 as required via line 21 to maintain a preselected minimum operating pressure. The gas flow is controlled by regulating valve 21*a*.

The polymer solution from pressure tank 20 is fed to sealed vessel 30 via line 22. The rate of flow of polymer solution through line 22 and the pressure on the polymer solution at the discharge orifice(s) of line 22 are controlled by pump 23. Isopropanol is continuously introduced into vessel 30 via line 32 at a rate such that the liquid level in vessel 30 is continuously maintained above the discharge orifice of line 22. The isopropanol typically is introduced at a rate to deliver about 100 parts by weight of isopropanol to vessel 30 for each 3 parts by weight of polymer introduced via line 22. Vessel 30 is maintained under substantially atmospheric pressure. The temperature within vessel 30 is maintained between ambient temperature and the boiling point of methylene chloride. The required heat is provided principally by the hot polymer solution, but may be supplemented by auxiliary heating means not shown. As the hot polymer solution is discharged from the discharge orifice(s) of line 22, it expands rapidly by reason of the pressure differential existing between pressure tank 20 and vessel 30. The polymer undergoes significant shear by reason of the expansion of the polymer solution as it is discharged from line 22. The shear imposed on the polymer orients the polymer molecules. The rapid cooling of the polymer solution, coupled with the dilution of the polymer solution with isopropanol, precipitates the polymer to form fibrils which have orientation "frozen" therein. A substantial quantity of methylene chloride is vaporized at the prevailing temperature and removed via line 34. The isopropanol is stirred vigorously to disperse the fibrils and form a slurry.

A slurry of the fibrils in liquid isopropanol, which may contain some methylene chloride, is transferred via line 40 to flash distillation apparatus 42. The temperature within 42 is maintained sufficiently high so that substantially all of the methylene chloride carried into the apparatus is vaporized and removed via line 44.

A slurry of fibrils in isopropanol substantially free of methylene chloride is removed from distillation apparatus 42 via line 46. This slurry is fed to refining apparatus 50. The refined fibrils slurried in the isopropanol are removed from the discharge side of refining apparatus 50 via line 52. The slurry from line 52 is fed to separation apparatus 54. The isopropanol is discharged via line 56 and recycled to line 32. The recovered fibrils are recovered via line 60.

If desired, the fibrils from line 60 can be diverted via line 61 to a product recovery station. It is preferred practice, however, to treat the recovered fibrils with an aqueous solution of polyvinyl alcohol (PVA). The fibrils are fed via line 60, together with aqueous PVA solution (typically containing 6–10 weight % PVA) from line 66 to a second refining apparatus 64. The slurry of PVA-treated fibrils is transferred via line 70 to separating apparatus 72. The refined fibrils are recovered via line 74 with the spent PVA solution being removed via line 76.

The methylene chloride recovered from vessel 30 and flash distillation apparatus 42 is fed via line 34 to approximately the midpoint of distillation column 80. The lower boiling methylene chloride is recovered as an overhead fraction via line 82 and is transferred to intermediate storage vessel 84. The methylene chloride from intermediate storage tank 84 is recycled to the process via line 90 and line 12.

Any isopropanol carried into distillation column 80 is recovered as a bottoms fraction via line 86 and is transferred to intermediate storage tank 88. Isopropanol from intermediate storage tank 88 is fed via line 92 to line 56 which recycles isopropanol from separation apparatus 54 to line 32. As some small quantity of methylene chloride can be carried through the various processing steps to the separation apparatus 54, it is possible that over extended periods of operation there will be some undesired buildup of methylene chloride in the isopropanol recycled to vessel 30 via line 56. When this occurs, a slipstream can be removed from line 56 via line 94. This slipstream can be fed to distillation column 80 by lines not shown.

The fibrils of the invention provide excellent properties when employed to prepare water-laid sheets. Water-laid sheets prepared solely from such fibrils provide sheets having an excellent balance of properties having the minimum factored values* set forth below:

| Property | Minimum Value |
|---|---|
| Mullen Burst | 30 psi |
| Elmendorf Tear Strength | 300 grams/sheet |
| Tensile Strength | 15 lbs/inch |
| Elongation at Break | 40% |

*Factored values are obtained by dividing the measured property by the sheet's basis weight (in grams/sq. meter) and multiplying by 100.

The tear strength values are particularly significant in that the greatest shortcoming of prior art fabrils is that sheets prepared therefrom have unacceptably low tear values.

Although water-laid sheets prepared from the fibrils of the invention will be inherently higher in cost than corresponding sheets prepared from cellulose pulps, sheets prepared from the fibrils of the invention will have properties not obtainable from cellulose fibers. Such sheets will be attractive when their properties will justify a premium price. In particular, such sheets will have high strength per unit weight, excellent tear resistance, good printing qualities, and good wear resistance.

A particularly desirable characteristic of the fibrils of the invention is that they can be blended in small quantities with cellulose pulps to significantly increase the tear strength of water-laid sheet prepared from such mixed pulps. Such sheets will contain at least 90 weight % of cellulose paper making fibers and up to about 10 weight % of the fibrils of the invention. The fibrils can be employed in an amount of about 0.5–10 weight %, preferably about 2–8 weight %, and especially about 4–6 weight %, said percentages being based on the combined weight of the cellulose fibers and fibrils. With certain types of cellulose pulps, the fibrils can be employed in excess of 10 weight % of the total fibers to obtain still greater improvements in certain paper properties. The further improvements obtained tend to be marginal and are not justified on an economic basis. The greatest technical and economic benefits presently visualized are obtained when the fibrils are blended with pulps which customarily give papers having relatively low tear values. It has been demonstrated that the addition of as little as 5 weight % of the fibrils to 95 weight % of certain hardwood kraft pulps will give papers having tear values up to 40% higher than corresponding values obtained with paper prepared from 100% of the pulp. It is known that papers prepared from certain groundwood pulps have tear values so low that they cannot be measured. The addition of 5 weight % fibrils to 95 weight % of such groundwood pulps provides papers having tear values of 10–20 grams per sheet.

The following examples are set forth to illustrate the principle and practice of the invention to those skilled in the art. Where parts or percentages are set forth, they are parts or percentages by weight unless otherwise indicated. As earlier noted, the terms employed to define the fibrils and the ethylene polymer from which they were prepared are defined infra in the section entitled "Definition of Terms and Test Methods." All paper properties are reported on a factored basis, i.e., the measured value is divided by the basis weight of the sheet.

EXAMPLE 1

A lot of fibrils was prepared from an ethylene polymer having a density of about 0.94 gram/ml, a melt temperature of 142° C., an apparent melt viscosity of $2.3\times10^6$ poises at 300° C. measured at an apparent shear rate of 1 second$^{-1}$, and a molecular weight of 2 million. The fibrils were prepared by the process discussed supra. A 2 weight % polymer solution was maintained in the first zone by feeding 2 parts of the ethylene polymer and 98 parts of methylene chloride to said zone. The first zone was maintained at a temperature of 150° C. and a pressure of about 33 atmospheres. The hot polymer solution was transferred to the second zone through 0.5" O.D. pressure resistant steel tubing. The end of the tubing was fitted with a sealing cap having drilled therein four (4) 1/16" diameter orifices. The transfer orifices discharged into a stirred bath of isopropanol. After being refined in isopropanol, the fibrils were refined in an aqueous PVA solution.

The recovered fibrils had a melt temperature of 139° C., a molecular weight of 396,000, a zero-span breaking length of 30,500, and had 8.9 weight % polyvinyl alcohol sorbed thereon. The fibrils' molecular weight was only 20% of the molecular weight of the ethylene polymer from which they were prepared.

COMPARISON CONTROLS

A series of ethylene polymer fibrils were prepared and/or purchased from commercial sources for use as controls in manufacturing water-laid sheets to compare properties with corresponding sheets from the fibrils of the invention.

Control A was a lot of polyethylene fibrils sold by Crown-Zellerbach. The fibrils had a melt temperature of 133° C., a molecular weight of 67,000, and a zero-span breaking length of 3,800. The fibrils contained no sorbed polyvinyl alcohol as measured by the analytical method discussed infra.

Control B was a lot of polyethylene fibrils sold by Solvay & Cie. The fibrils had a melt temperature of 136° C., a molecular weight of 72,000, and a zero-span breaking length of 10,200. The fibrils had 1.0 weight % polyvinyl alcohol sorbed thereon.

As Controls A and B were purchased products, the characteristics of the ethylene polymers from which they were prepared are not known. Presumedly these fibrils represent the best quality product that the suppliers can prepare.

Control C was a lot of fibrils prepared as described in U.S. Pat. No. 4,237,081. After being prepared, the fibrils were refined in isopropanol and then refined with an aqueous solution of polyvinyl alcohol as described in U.S. Pat. No. 4,049,493 before drying. The fibrils were prepared from an ethylene polymer having a density of about 0.94 grams/ml, a melt temperature of about 144° C., and a molecular weight of about 5 million. The fibrils had a melt temperature of about 141° C., a molecular weight of about 2 million, a zero-span breaking length of about 18,000, and had about 8.7 weight % of polyvinyl alcohol sorbed thereon.

EXAMPLE 2

Water-laid hand sheets were prepared using a Noble and Wood machine. Sheets were prepared from the fibrils of Example 1 and Controls A, B, and C. The factored properties of the sheets are shown in Table I.

TABLE I

| Property | Sample: Example 1 | Control A | Control B | Control C |
|---|---|---|---|---|
| Basis Weight (1) | 63 | 60.4 | 58.0 | 58.6 |
| Mullen Burst (2) | 42 | 13 | 3 | 39 |
| Elmendorf Tear (3) | 351 | 61 | 17 | 133 |
| Tensile (4) | 25 | 7.3 | 2 | 13 |
| Elongation (5) | 52 | 24 | 4 | 85 |

(1) grams/meter$^2$
(2) psi
(3) grams/sheet
(4) lbs/inch
(5) percent

EXAMPLE 3

Hand sheets were prepared from a blend of 95 weight % of a hardwood kraft pulp supplied from Champion International and 5 weight % of fibrils of Example 1. The fibrils were slurried in water to prepare a suspension containing 1 weight % of solids. This suspension was refined for 2 minutes in a Waring Blendor. Five (5) parts of this suspension were added to 95 parts of a 1% suspension of the hardwood pulp in water. The mixed furnish then was refined for 1.5 minutes in a laboratory size Mead refiner. Hand sheets were made on a Noble & Wood sheet machine.

The factored Elmendorf tear and the tensile values of the dried sheets prepared from the mixed furnish and sheets prepared from the hardwood kraft pulp are shown in Table II. The factored values for sheets prepared entirely from Controls A and B are included for comparison purposes.

TABLE II

| Property | Pulp Source: 100% Hardwood Kraft | 100% Control A | 100% Control B | 95% Hardwood Kraft/ 5% Fibrils |
|---|---|---|---|---|
| Elmendorf Tear* | 103 | 61 | 17 | 126 |
| Tensile* | 21 | 7.3 | 2 | 25 |

*Factored values as previously defined.

It is seen that the inclusions of only 5 weight % of the fibrils of the invention in the hardwood kraft pulp significantly increased the tear and tensile values of the sheets made from the hardwood kraft.

EXAMPLE 4

Additional paper sheets were prepared from 95 weight % of the hardwood kraft pulp of Example 3 and 5 weight % of the fibrils of Example 1. In this example, different refining conditions were employed. In Run A (a control) a 1% furnish of the hardwood kraft pulp was refined for 2 minutes in a Waring Blendor. In Run B (also a control) a 1% furnish of the hardwood kraft pulp was refined for 4 minutes in a Waring Blendor. In Run C, a 1% furnish of the fibrils was refined for 1 minute in a Waring Blendor. Five (5) parts of this furnish were added to 95 parts of a 1% furnish of the hardwood kraft pulp. The mixed furnish then was refined for 2 minutes in the Waring Blendor. Run D was identical to Run C except that the mixed furnish was refined for 4 minutes in the Waring Blendor. Run E was identical to Run C except that the fibrils were refined for 2 minutes in the Waring Blendor. The properties of sheets prepared from these furnishes are shown in Table III.

TABLE III

| | Run | | | | |
|---|---|---|---|---|---|
| | A (Control) | B (Control) | C | D | E |
| Basis wt, g/m$^2$ | 48 | 47 | 52 | 62 | 57 |
| Tear, g/sheet | 60 | 58 | 85 | 101 | 85 |
| Tensile, lb/inch | 18 | 17 | 13 | 17 | 16 |
| TEA, ft-lbs/ft | 2.8 | 2.4 | 1.8 | 2.7 | 2.5 |
| Elongation, % | 3.5 | 3.5 | 2.9 | 2.8 | 3.1 |

The data show that the fibrils provide a very significant increase in tear strength as compared with the controls. The variation of Tear, Tensile, and TEA in Runs C, D, and E suggests that a somewhat better balance of properties can be obtained by optimizing the refining conditions for the mixed furnish.

EXAMPLE 5

Paper sheets were prepared from a softwood kraft pulp supplied by St. Regis Paper Company with a Hinton Hi-Brite designation and the fibrils described in Example 1. In Run A (a control) a 1% furnish of the soft wood pulp was refined in a Waring Blendor to a Canadian Freeness of 500. In Run B, the fibrils were slurried to form a 1% furnish, but the furnish was not refined. Five (5) parts of the fibril furnish was added to 95 parts of the softwood pulp furnish. The mixed pulp then was refined in a Waring Blendor to a Canadian Freeness of 500. Runs C, D, and E were identical to Run B except that the fibril furnish was refined in a Waring Blendor for 4 minutes (Run C), 8 minutes (Run D), or 12 minutes (Run E) before being added to the softwood furnish. The properties of sheets prepared from these furnishes are shown in Table IV.

TABLE IV

| | Run | | | | |
|---|---|---|---|---|---|
| | A (Control) | B | C | D | E |
| Basis wt, g/m$^2$ | 62 | 62 | 61 | 60 | 60 |
| Tear, g/sheet | 119 | 129 | 130 | 140 | 142 |
| Tensile, lb/inch | 51 | 48 | 47 | 47 | 47 |
| TEA, ft-lbs/ft$^2$ | 17 | 16 | 16 | 16 | 16 |
| Elongation, % | 7 | 7 | 7 | 7 | 7 |

It is seen that with this system, the inclusion of the fibrils in the sheet significantly improves the tear strength with a very modest decrease in tensile. The tear strength increased with an extension of the time of fibril refining before blending the fibrils with the cellulose furnish.

When the work reported in Examples 3, 4, or 5 is repeated, except that the Control A or Control B fibrils are substituted for the fibrils prepared in Example 1, the tear values of the sheets prepared from the mixed or blended pulp are lower than the tear values of the sheets prepared from 100% of the cellulose fibers.

DEFINITIONS OF TERMS AND TEST METHODS

The molecular weights for ethylene polymers having molecular weights of up to 600,000 are determined by measuring the polymer's apparent melt viscosity at 190° C. at several apparent shear rates. Such data can be obtained in a capillary rheometer operated under conditions of constant shear rate. These data are plotted on log - log paper. From the plot, the apparent melt viscosity at zero shear is determined by extrapolation. The molecular weight is calculated from this value using the method of L. H. Tung reported at *J. Poly Sci* 46, 409 (1960). The equation employed is:

$$\log \eta = 3.4 \log \overline{M}_w + (1.64 \times 10^3/T) - 15.5$$

where $\eta$ is the melt viscosity at zero shear.

The method described above is not suitable for determining molecular weights of ethylene polymers having molecular weights higher than 700,000. The molecular weight of such polymers are determined by measuring the polymer's apparent melt viscosity at 1 second$^{-1}$. The molecular weight then is calculated from the formula:

$$\text{Mol. wt.} = M.M.V. - 0.3 \times 10^6$$

where M.M.V. is the measured melt viscosity (in poises) as determined in a capillary rheometer at 300° C. at an apparent shear rate of 1 second$^{-1}$ (1 reciprocal second). The above formula was derived by measuring the melt viscosity of several ultrahigh molecular weight ethylene polymers whose molecular weights had been previously established as industry standards. The correlation between established molecular weights and measured melt viscosities (M.M.V.) over a range from 700,000 to 2,500,000 was

| Molecular Weight | M.M.V. |
|---|---|
| 700,000 | $1.0 \times 10^6$ |
| 1,000,000 | $1.3 \times 10^6$ |
| 1,500,000 | $1.8 \times 10^6$ |
| 2,000,000 | $2.3 \times 10^6$ |
| 2,500,000 | $2.8 \times 10^6$ |

The melt temperature of an ethylene polymer is defined as the temperature at which the peak occurs in the polymer's melt endotherm as determined in a differential scanning calorimeter.

The percent of polyvinyl alcohol (PVA) sorbed on the ethylene polymer fibrils is determined by acetylating the PVA in pyridine, followed by titration of the acetic acid produced. This method is described at *Analytical Chemistry of Polymers, Part* I, Gordon Kline, ed., Interscience Publishers, N.Y., 1959, p. 481.

The density of an ethylene polymer is determined by ASTM D 1505-68.

The zero-span breaking length of the ethylene polymer fibrils is determined by TAPPI methods T231 and T481.

The methods for determining properties of water-laid hand sheets are:

| Property | TAPPI Method |
|---|---|
| Mullen Burst | T 403 |
| Elmendorf Tear | T 414 |
| Tensile Strength | T 494 |
| Elongation | T 494 |

What is claimed:

1. Ethylene polymer fibrils which can be converted to a water-laid hand sheet having the following minimum factored values:

Mullen Burst: 30 psi

Elmendorf Tear Strength: 300 grams/sheet

Tensile Strength: 15 lbs/inch

Elongation at Break: 40% said fibrils being characterized in having;

(a) a melt temperature of at least about 137° C., (b) a molecular weight of at least 250,000, (c) at least about 1.2 weight % of polyvinyl alcohol sorbed thereon, (d) a zero-span breaking length of at least about 25,000;

said fibrils being further characterized in having been prepared:

(1) from an ethylene polymer having a density of at least about 0.93 grams/ml, a melt temperature of at least 140° C., and an apparent melt viscosity of at least about $1.3\times10^6$ poises at 300° C. at an apparent shear rate of 1 $second^{-1}$;

(2) by a process including the steps of;

(i) dissolving the ethylene polymer of (1) above in a solvent at an elevated temperature of at least about 125° C., (ii) subjecting the ethylene polymer solution of (i) above to intense shearing conditions, (iii) immediately after or simultaneously with the imposition of said shearing conditions upon said ethylene polymer solution cooling said solution and/or adding thereto a miscible liquid which is a nonsolvent for said ethylene polymer so as to precipitate ethylene polymer fibrils therefrom, (iv) recovering the ethylene polymer fibrils from step (iii).

(v) treating the recovered ethylene polymer fibrils with a liquid that is miscible with both water and the solvent employed in step (i) to remove substantially all of said solvent from the recovered fibrils, and (vi) treating the ethylene polymer fibrils from step (v) with an aqueous solution of polyvinyl alcohol so as to sorb polyvinyl alcohol on said fibrils, the temperature employed in step (2) (i), the time period in which the ethylene polymer solution is maintained at such temperature, and the intensity of the shear imposed on the ethylene polymer solution in step (2) (ii) being such that the molecular weight of the ethylene polymer in the recovered fibrils is less than 35% of the molecular weight of the ethylene polymer as set forth in step (i).

2. Ethylene polymer fibrils of claim 1 in which the fibrils are characterized in having:

(a) a melt temperature of at least 138° C., (b) a molecular weight of at least 300,000, (c) at least about 4.0 weight % of polyvinyl alcohol sorbed thereon, and (d) a zero-span breaking load of at least about 30,000;

said fibrils being further characterized in having been prepared from an ethylene polymer having a density of at least 0.94.

3. Ethylene polymer fibrils of claim 1 or 2 in which the fibrils are prepared by a process which consists essentially of:

(a) introducing the ethylene polymer and a solvent therefor into a first zone, (b) heating said first zone to a temperature above the atmospheric boiling point of said solvent so as to maintain said ethylene polymer in solution and to maintain said first zone under super-atmospheric pressure, (c) transferring polymer solution from said first zone to a second zone through an elongated tube-like transfer member, (d) feeding a propanol to said second zone to continuously maintain liquid propanol above the discharge orifice of the transfer member, (e) maintaining a temperature in said second zone such that:

(i) the propanol is maintained in the liquid state, and (ii) the pressure is lower than the pressure in the first zone, (f) Stirring the liquid propanol in said second zone, (g) precipitating ethylene polymer in said second zone to form fibrils, (h) distilling at least a portion of the polymer solvent from said second zone, (i) removing a slurry of fibrils and propanol from said second zone, (j) flash distilling the bulk of any polymer solvent remaining in the slurry recovered in step (i), (k) passing the fibril-propanol slurry from step (j) through refining apparatus to refine the fibrils, (m) recovering refined fibrils and propanol from the slurry of step (k), and (n) recovering the polymer solvent and propanol and recycling same to steps (a) and (d) of the process;

the solvent employed in step (a) being characterized in (1) having the capacity of dissolving at least about 1.0 weight % of the ethylene polymer at the temperature employed in step (b), (2) having the capacity of dissolving not more than about 0.2 weight % of the ethylene polymer at ambient temperature when diluted with an equal volume of propanol, (3) having an atmospheric boiling point of less than about 65° C., and (4) not forming an azeotrope with the propanol employed in step (d).

* * * * *